US007664230B2

(12) United States Patent
Morton et al.

(10) Patent No.: US 7,664,230 B2
(45) Date of Patent: Feb. 16, 2010

(54) X-RAY TUBES

(75) Inventors: Edward James Morton, Guildford (GB); Russell David Luggar, Dorking (GB); Paul De Antonis, Horsham (GB)

(73) Assignee: Rapiscan Systems, Inc., Hawthorne, CA (US)

( * ) Notice: Subject to any disclaimer, the term of this patent is extended or adjusted under 35 U.S.C. 154(b) by 0 days.

(21) Appl. No.: 10/554,654

(22) PCT Filed: Apr. 23, 2004

(86) PCT No.: PCT/GB2004/001731

§ 371 (c)(1),
(2), (4) Date: Feb. 7, 2008

(87) PCT Pub. No.: WO2004/097886

PCT Pub. Date: Nov. 11, 2004

(65) Prior Publication Data

US 2008/0144774 A1 Jun. 19, 2008

(51) Int. Cl.
*H01J 35/10* (2006.01)

(52) U.S. Cl. ..... 378/141; 378/121

(58) Field of Classification Search ..... 378/119, 378/121, 127, 128, 138, 140, 143, 144
See application file for complete search history.

(56) References Cited

U.S. PATENT DOCUMENTS

| | | | |
|---|---|---|---|
| 2,952,790 | A | 9/1960 | Steen |
| 3,239,706 | A | 3/1966 | Farrell et al. |
| 3,768,645 | A | 10/1973 | Conway et al. |
| 4,057,725 | A | 11/1977 | Wagner |
| 4,105,922 | A | 8/1978 | Lambert et al. |
| 4,228,353 | A | 10/1980 | Johnson |
| 4,259,721 | A | 3/1981 | Kuznia |
| 4,266,425 | A | 5/1981 | Allport |
| 4,274,005 | A | 6/1981 | Yamamura et al. |
| 4,340,816 | A | 7/1982 | Schott |
| 4,352,021 | A | 9/1982 | Boyd et al. |
| 4,468,802 | A | 8/1984 | Friedel |
| 4,672,649 | A | 6/1987 | Rutt |
| 4,675,890 | A | 6/1987 | Plessis et al. |
| RE32,961 | E | 6/1989 | Wagner |
| 4,866,745 | A | 9/1989 | Akai |
| 4,868,856 | A | 9/1989 | Frith et al. |

(Continued)

FOREIGN PATENT DOCUMENTS

| | | |
|---|---|---|
| DE | 2729353 | 1/1979 |

(Continued)

OTHER PUBLICATIONS

US 5,987,079, 11/1999, Scott et al. (withdrawn)

*Primary Examiner*—Courtney Thomas
(74) *Attorney, Agent, or Firm*—PatentMetrix

(57) ABSTRACT

The present invention is directed to an X-ray tube that has an electron source in the form of a cathode and an anode within a housing. The anode is a thin film anode, so that most of the electrons which do not interact with it to produce X-rays pass directly through it. A retardation electrode is located behind the anode and is held at a potential which is negative with respect to the anode and slightly positive with respect to the cathode.

16 Claims, 4 Drawing Sheets

U.S. PATENT DOCUMENTS

| | | | | |
|---|---|---|---|---|
| 4,887,604 | A | | 12/1989 | Shefer et al. |
| 5,033,106 | A | | 7/1991 | Kita |
| 5,247,556 | A | | 9/1993 | Eckert et al. |
| 5,259,014 | A | | 11/1993 | Brettschneider |
| 5,272,627 | A | | 12/1993 | Maschhoff et al. |
| 5,313,511 | A | | 5/1994 | Annis et al. |
| 5,367,552 | A | | 11/1994 | Peschmann |
| 5,467,377 | A | | 11/1995 | Dawson |
| 5,511,104 | A | | 4/1996 | Mueller et al. |
| 5,604,778 | A | | 2/1997 | Polacin et al. |
| 5,633,907 | A | | 5/1997 | Gravelle et al. |
| 5,689,541 | A | | 11/1997 | Schardt |
| 5,841,831 | A | | 11/1998 | Hell et al. |
| 5,859,891 | A | | 1/1999 | Hibbard |
| 5,966,422 | A | | 10/1999 | Dafni et al. |
| 5,974,111 | A | | 10/1999 | Krug et al. |
| 5,987,097 | A | * | 11/1999 | Salasoo ..... 378/141 |
| 6,018,562 | A | | 1/2000 | Willson |
| 6,122,343 | A | | 9/2000 | Pidcock |
| 6,181,765 | B1 | | 1/2001 | Sribar et al. |
| 6,183,139 | B1 | | 2/2001 | Solomon et al. |
| 6,218,943 | B1 | | 4/2001 | Ellenbogen |
| 6,236,709 | B1 | | 5/2001 | Perry et al. |
| 6,269,142 | B1 | | 7/2001 | Smith |
| 6,324,249 | B1 | | 11/2001 | Fazzio |
| 6,546,072 | B1 | | 4/2003 | Chalmers |
| 6,735,271 | B1 | | 5/2004 | Rand et al. |
| 2001/0022346 | A1 | | 9/2001 | Katagami et al. |
| 2002/0031202 | A1 | | 3/2002 | Callerame et al. |
| 2002/0094064 | A1 | | 7/2002 | Zhou et al. |
| 2002/0176531 | A1 | | 11/2002 | McClelland et al. |
| 2003/0031352 | A1 | | 2/2003 | Nelson et al. |
| 2004/0120454 | A1 | | 6/2004 | Ellenbogen et al. |
| 2004/0252807 | A1 | | 12/2004 | Skatter et al. |
| 2004/0258305 | A1 | | 12/2004 | Burnham et al. |
| 2005/0031075 | A1 | | 2/2005 | Hopkins et al. |
| 2005/0053189 | A1 | | 3/2005 | Gohno et al. |
| 2005/0105682 | A1 | | 5/2005 | Heumann et al. |
| 2005/0111610 | A1 | | 5/2005 | De Man et al. |
| 2005/0157925 | A1 | | 7/2005 | Lorenz |

FOREIGN PATENT DOCUMENTS

| | | |
|---|---|---|
| EP | 0 432 568 | 6/1991 |
| EP | 0 531 993 | 3/1993 |
| EP | 0 584 871 | 3/1994 |
| EP | 0 924 742 | 6/1999 |
| EP | 0 930 046 | 7/1999 |
| EP | 1 277 439 | 1/2003 |
| EP | 1374776 | 1/2004 |
| GB | 1497396 | 1/1978 |
| GB | 1526041 | 9/1978 |
| GB | 2 015 245 | 9/1979 |
| GB | 2089109 | 6/1982 |
| GB | 2 212 903 | 8/1989 |
| JP | 2004 079128 | 3/1992 |
| JP | 2001 176408 | 6/2001 |
| WO | WO 95/28715 | 10/1995 |
| WO | WO 99/60387 | 11/1999 |
| WO | WO 03/051201 | 6/2003 |
| WO | PCT/GB2004/001729 | 8/2004 |

* cited by examiner

X-RAY TUBES

CROSS-REFERENCE TO RELATED APPLICATIONS

The present application is a national stage application of PCT/GB2004/001731, filed on Apr. 23, 2004. The present application further relies on Great Britain Patent Application Number 0309371.3, filed on Apr. 25, 2003, for priority.

BACKGROUND OF THE INVENTION

The present invention relates to X-ray tubes and in particular to controlling the amount of heat produced in the tube housing.

It is known to provide an X-ray tube which comprises an electron emitter and a metal anode where the anode is held at a positive potential (say 100 kV) with respect to the electron emitter. Electrons from the emitter accelerate under the influence of the electric field towards the anode. On reaching the anode, the electron loses some or all of its kinetic energy to the anode with over 99% of this energy being released as heat. Careful design of the anode is required to remove this heat.

Electrons that backscatter from the anode at low initial energy travel back down the lines of electrical potential towards the electron source until their kinetic energy drops to zero. They are then accelerated back towards the anode where their kinetic energy results in generation of further heat (or X-radiation).

Electrons that scatter from the anode at higher energies can escape the lines of electrical potential that terminate at the anode and start to travel towards the tube housing. In most X-ray tubes, the electrons can reach the housing with high kinetic energy and the localised heating of the housing that results can lead to tube failure.

SUMMARY OF THE INVENTION

The present invention provides an X-ray tube comprising, a cathode arranged to provide a source of electrons, an anode held at a positive potential with respect to the cathode and arranged to accelerate electrons from the cathode such that they will impact on the anode thereby to produce X-rays, and a retardation electrode held at a negative potential with respect to the anode thereby to produce an electric field between the anode and the retardation electrode which can slow down electrons scattered from the anode thereby reducing the amount of heat they can generate in the tube.

Preferably the retardation electrode is held at a positive potential with respect to the cathode.

Preferably the retardation electrode forms part of an electrical circuit so that electrons collected by the retardation electrode can be conducted away from it thereby maintaining its potential substantially constant.

The X-ray tube may include a housing enclosing the anode and the cathode, and at least a part of the housing may form the retardation electrode. Alternatively the retardation electrode may be located between the anode and the housing thereby to slow down electrons before they reach the housing.

The anode is preferably supported on a backing layer of lower atomic number than the anode. Preferably the anode has a thickness of the order of 5 microns or less.

BRIEF DESCRIPTION OF THE DRAWINGS

Preferred embodiments of the present invention will now be described by way of example only with reference to the accompanying drawings in which.

DETAILED DESCRIPTION OF THE DRAWINGS

Figure 1:
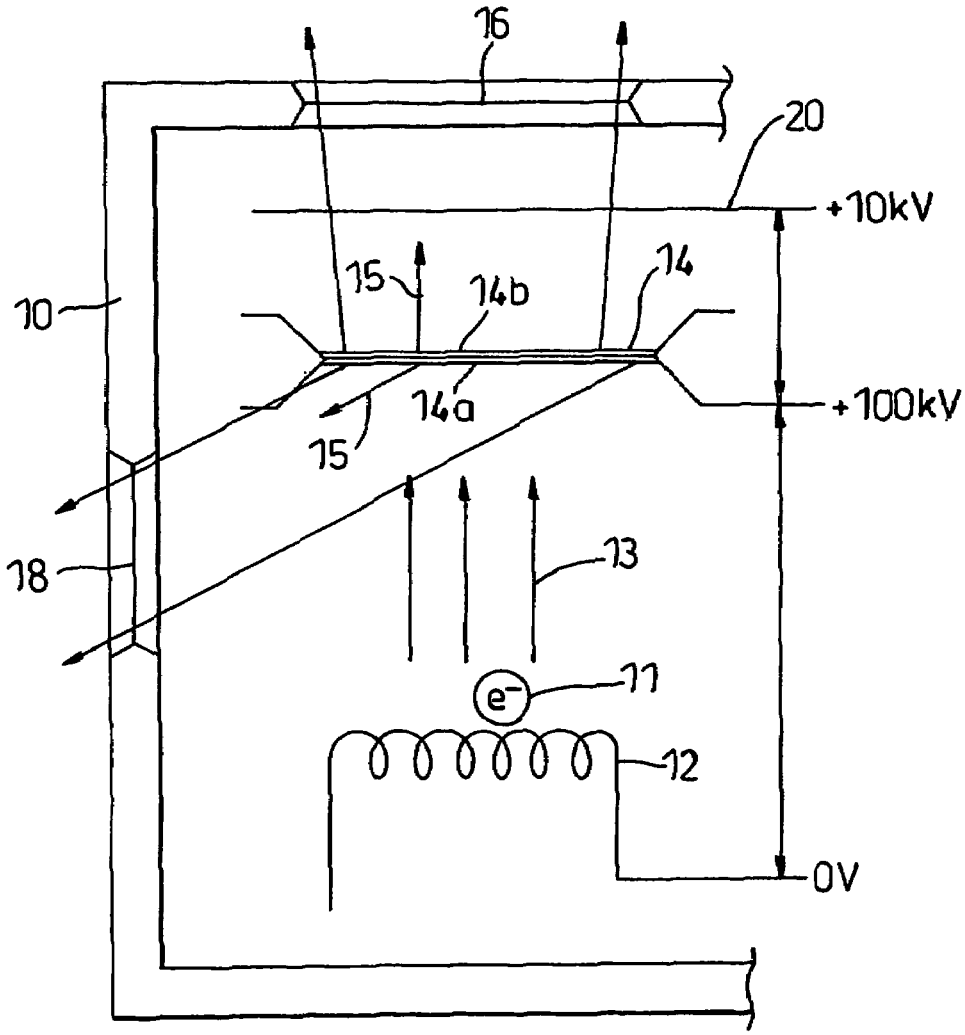
FIG. 1 is a diagram of an X-ray tube according to a first embodiment of the invention.

Referring to FIG. 1 an X-ray tube comprises a housing 10 which encloses an electron source in the form of a cathode 12, and a thin film anode 14. The anode comprises a thin film 14*a* of a high atomic number target material, in this case tungsten, supported on a backing 14*b* of a low atomic number material, in this case boron. Boron is suitable due to its high thermal conductivity and low probability of electron interaction, both of which help to reduce the build up of heat in the anode 14. The thin film 14*a* of tungsten may have a thickness of from 0.1 to 5 micron and the backing 14*b* has a thickness of from 10 to 200 micron. The cathode 12 and anode 14 are connected into an electrical circuit 15 which maintains the cathode 12 at a fixed negative potential with respect to the anode 14, in this case −100 kV. This achieved by keeping the anode at a fixed positive potential and the cathode at either a fixed negative potential or at ground potential. The housing 10 has a first window 16 through it, on the opposite side of the anode to the cathode, and a second window 18 which is to one side between the anode 14 and cathode 12. A retardation electrode 20 is also located inside the housing 10, between the anode 14 and the first window 16, i.e. on the opposite side of the anode 14 to the cathode 12. The retardation electrode is in the form of a sheet of stainless steel foil having a thickness of 100 to 500 microns extending substantially parallel to the thin film anode 14 and the first window 16. Molybdenum sheet can also be used. The retardation electrode 20 is also connected into the electric circuit and is held at a fixed potential which is positive with respect to the cathode 12, but much less so than the anode 14, in this case being at 10 kV with respect to the cathode.

In use, electrons 11 generated at the cathode 12 are accelerated as an electron beam 13 towards the anode 14 by the electric field between the cathode 12 and anode 14. Some electrons 11 interact with the anode 14 through the photoelectric effect to produce X-rays 15, which can be collected through the first windows 16, in a direction parallel with the incident electron beam 13, or through the second window 18, in a direction substantially perpendicular to the direction of the incident electron beam 13. X-rays are actually emitted from the anode in substantially all directions, and therefore need to be blocked by the housing 10 in all areas apart from the windows 16, 18.

The more energetic an electron, the more likely it is to interact with the anode 14 through the photoelectric effect. Consequently, the first interaction of any electron with the anode 14 is the one most likely to yield a fluorescence photon. An electron that scatters in the target has a probability of generating a bremsstrahlung X-ray photon, but the photon will usually be lower in energy than a fluorescence photon (especially from a high atomic number target such as tungsten). Therefore, for most imaging applications, X-rays resulting from photoelectric interactions are preferred.

Using Monte Carlo studies it is possible to show that virtually all fluorescence photons arise from the first electron interaction in the target 14. If the first interaction does not result in a fluorescence photon, it is very unlikely that any subsequent interaction will result in a fluorescence photon either. In high atomic number materials such as tungsten, the first electron interaction typically occurs very near to the anode surface e.g. within 1 micron of the surface. Therefore, it is advantageous to use the thin target 14 so that the ratio of fluorescence to bremsstrahlung radiation is maximised. Further, the heat dissipated in such a thin target 14 is low.

Electrons that do not interact in the thin target 14 will normally continue in the same straight line trajectory that they were following in the beam 13 as they entered the target 14 from the electron source 12. Electrons that pass through the anode 14 will slow down as they are retarded by the strength of the electric field in the region behind the anode 14, caused by the electrical potential between the anode 14 and the retardation electrode 20. When the electrons interact in the retardation electrode 20, they have low kinetic energy and consequently only a small thermal energy is deposited in the electrode. In this embodiment where the additional electrode is at a potential of 10 kV with respect to the electron source 12 but where the anode 14 is at 100 kV with respect to the electron source 12, then total thermal power dissipation in the X-ray tube will be around 10% of that in a conventional thick target X-ray source.

Figure 1A:
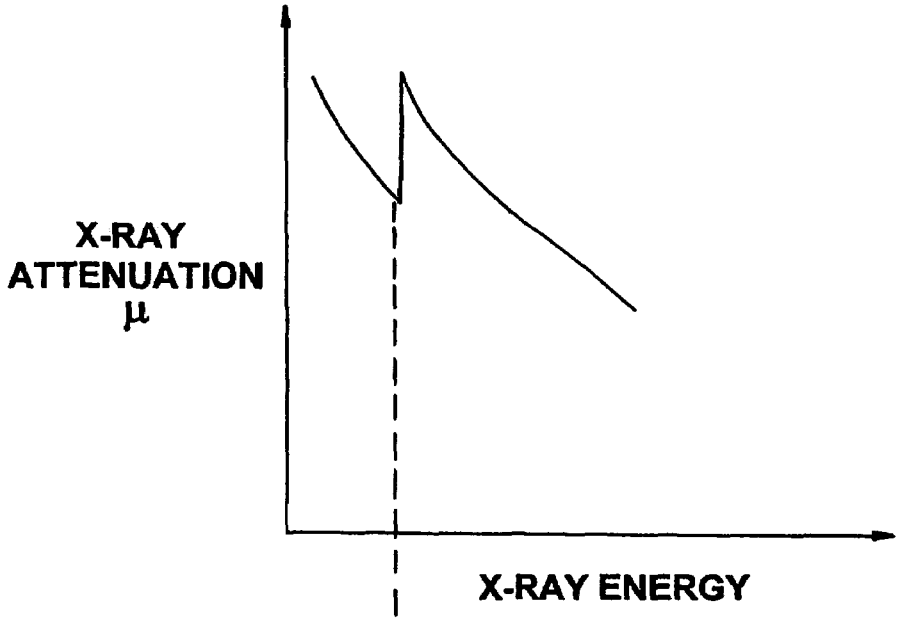
FIG. 1*a* is a graph showing the attenuation characteristics of a retardation electrode of the tube of FIG. 1.
Figure 1B:
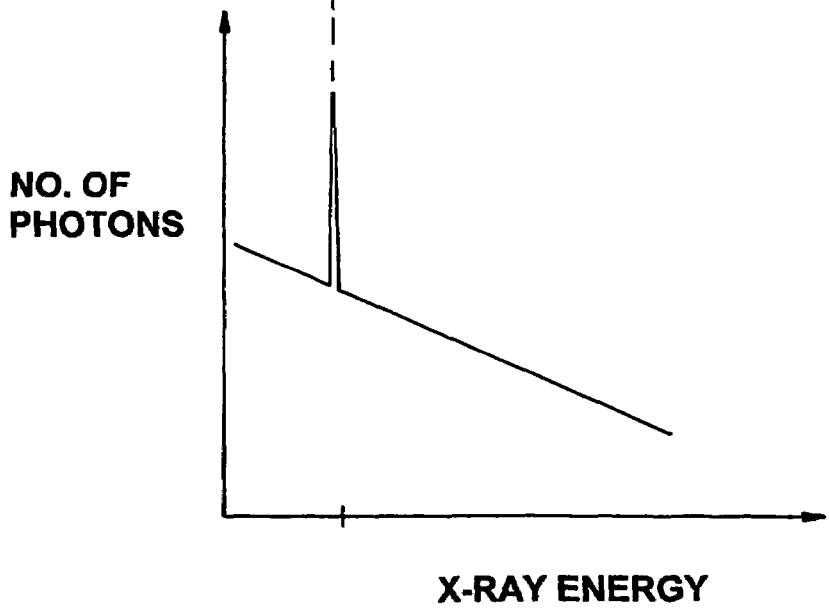
FIG. 1*b* is a graph showing the energies of X-rays produced by an anode of the tube of FIG. 1.

X-rays passing through the window 16 also have to pass through the retardation electrode 20. In this case it is important to ensure that the retardation electrode 20 blocks as few of the X-rays produced in the anode 14 as possible. Referring to FIG. 1*a* the X-ray attenuation coefficient μ of the retardation electrode 20 decreases generally with increasing X-ray energy, but has a sharp discontinuity where it increases sharply before continuing to decrease. This results in a region of minimum attenuation at energies just below the discontinuity. Referring to FIG. 1*b*, the energies of the X-rays produced in the anode decreases steadily with increasing energy due to the bremsstrahlung component of the radiation, but has a sharp peak at the peak energy which corresponds to fluorescent X-ray production. In order to maximise the proportion of the fluorescent X-rays passing through the retardation electrode 20, the energy of minimum attenuation in the retardation electrode is selected to correspond to the peak X-ray energy. For example, with a tungsten target, which produced fluorescent X-rays at energies $K_{\alpha 1}$=59.3 keV and $K_{\alpha 2}$=57.98 keV, a rhemium retardation electrode can be used which has absorption edges at 59.7 keV and 61.1 keV and is therefore substantially transparent to the X-rays at energies of 59.3 keV and, to a lesser degree, to those at energies of 57.98 keV.

Figure 2:
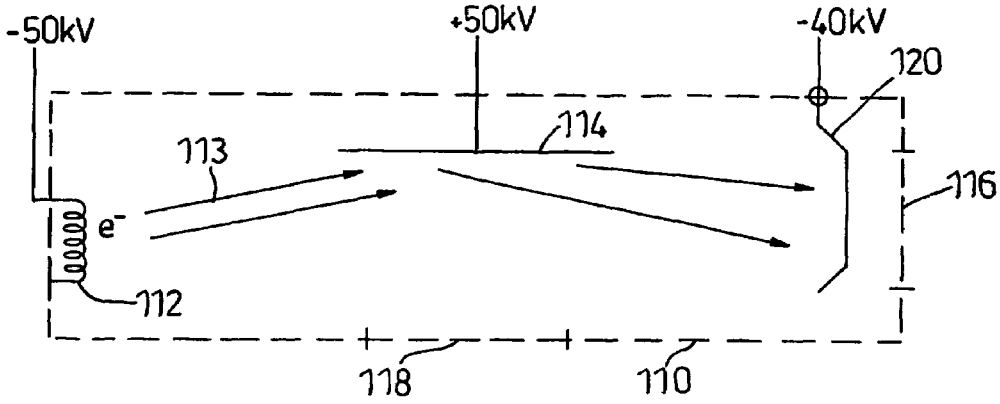
FIG. 2 is a diagram of an X-ray tube according to a second embodiment of the invention.

Referring to FIG. 2, in a second embodiment of this invention, the cathode 112 and anode 114 are set up so that the electron beam 113 interacts at glancing angle to the anode 114. In this type of set up, the energy deposited in the anode 114 is considerably reduced compared to conventional reflection anode X-ray tubes. Using Monte Carlo modelling, it can be shown that X-ray output is relatively little affected by the use of this geometry. However, the number of electrons that escape the anode 114 in the forward direction is high. A retardation electrode 120 is therefore provided to slow the forward directed scattered electrons down such that the thermal energy deposited in the tube housing 110 is reduced to tolerable levels. X-rays in this arrangement can be collected through a first window 116, which is behind the retardation electrode 120 so that the X-rays must pass through the retardation electrode 120 to reach the window 116, or a second window 118 in the side of the housing 110 facing the anode 114. As with the first embodiment, the housing 110 blocks the X-rays which are emitted in directions other than through the windows 116, 118.

Figure 3:
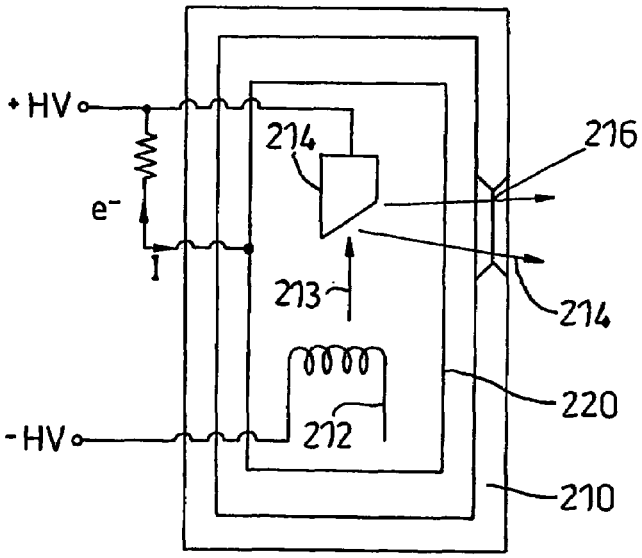
FIG. 3 is a diagram of an X-ray tube according to a third embodiment of the invention.

Referring to FIG. 3, in a third embodiment of this invention, an electron beam 213 from an electron source 212 is used to irradiate a typical reflection anode 214. Here, the anode 214 and electron source 212 are surrounded by a retardation electrode 220. In this embodiment the retardation electrode 220 comprises a metal foil, but an electrically conductive mesh could equally be used. The retardation electrode 220 is held at a negative potential with respect to the anode 214, but at a positive potential with respect to the electron source 212. Again, high energy scattered electrons from the anode 214 will decelerate in the electric field between the anode 214 and retardation electrode 220 thus reducing the overall heat load in the X-ray tube.

To set the potential of the retardation electrode 220, the retardation electrode 220 is electrically isolated from all elements in the tube and then connected to the anode 214 potential +HV by means of a resistor R. As electrons reach the retardation electrode 220, a current I will flow through the resistor R back to the anode power supply and the potential of the electrode will fall to be negative with respect to the anode. In this situation, the retardation electrode potential will be affected by the operational characteristics of the tube and will to some degree be self adjusting. Such an approach can also be used with retardation electrodes as shown in FIGS. 1 and 2 too.

Figure 4:
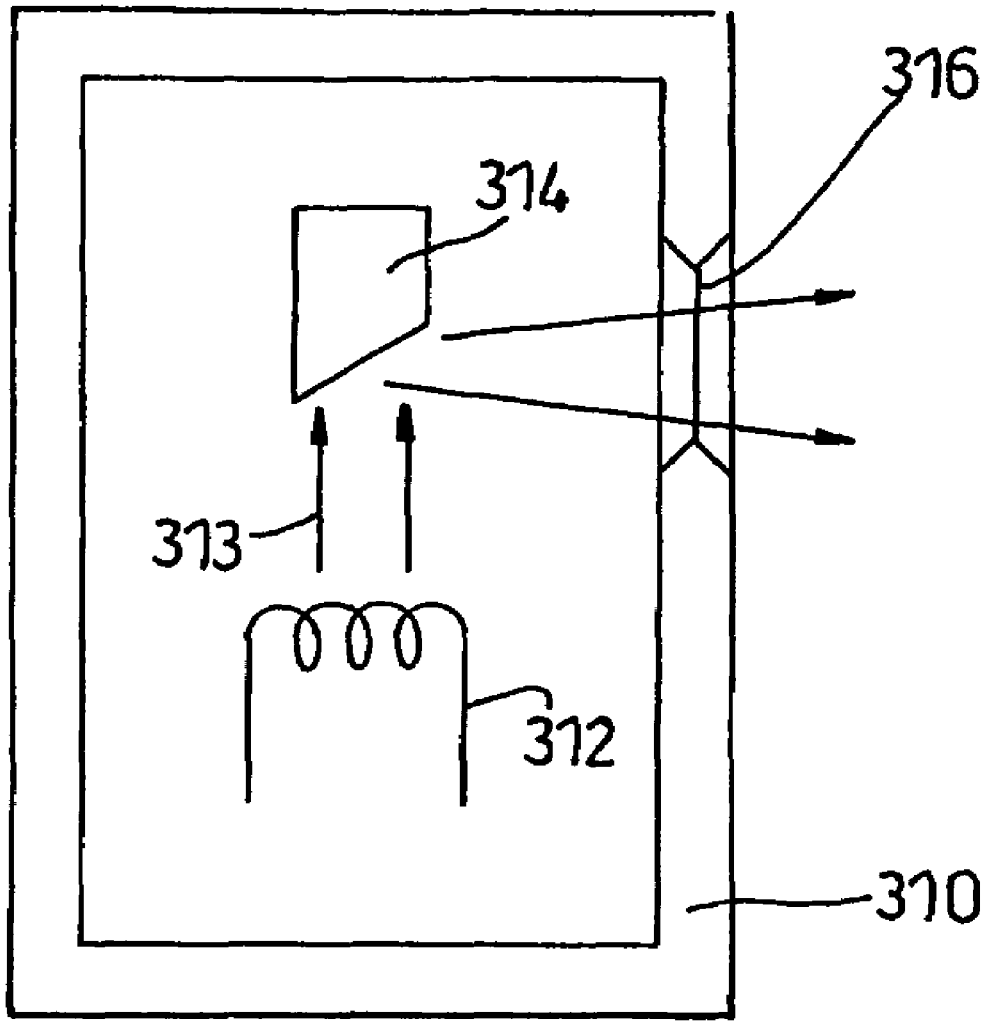
FIG. 4 is a diagram of an X-ray tube according to a fourth embodiment of the invention.

Referring to FIG. 4, in a fourth embodiment of the invention, the entire case 310 of the X-ray tube is used as the retardation electrode 320 by making it of a conductive material and fixing the potential of the X-ray tube case 310 slightly positive with respect to the electron source 312.

The invention claimed is:

1. A transmission target X-ray tube comprising:

a cathode arranged to provide a source of electrons;

an anode held at a positive potential with respect to the cathode to accelerate electrons from the cathode such that they will impact on the anode thereby to produce X-rays, wherein the anode is a thin film anode; and a retardation electrode held at a negative potential with respect to the anode to produce an electric field between the anode and the retardation electrode which slows down electrons which have passed through the anode thereby reducing the amount of heat they generate in the tube, wherein the retardation electrode is located on the opposite side of the anode to the cathode, wherein the retardation electrode forms part of an electrical circuit and its potential is substantially constant and wherein the retardation electrode is electrically connected to the anode via a resistor, wherein current flowing through the resistor determines the potential of the retardation electrode with respect to the anode.

2. A transmission target X-ray tube according to claim 1 further comprising: a housing enclosing the anode and the cathode, wherein at least a part of the housing forms the retardation electrode.

3. A transmission target X-ray tube according to claim 1 further comprising a housing, wherein the retardation electrode is located between the anode and the housing.

4. A transmission target X-ray tube according to claim 1 wherein the anode is supported on a backing layer of lower atomic number material than the anode.

5. A transmission target X-ray tube according to claim 1 wherein the retardation electrode is held at a positive potential with respect to the cathode.

6. A transmission target X-ray tube according to claim 1 wherein the retardation electrode is made of an electrically conducting material.

7. A transmission target X-ray tube comprising:

a cathode arranged to provide a source of electrons;

an anode held at a positive potential with respect to the cathode to accelerate electrons from the cathode such that they will impact on the anode thereby to produce X-rays, wherein the anode is a thin film anode; and a retardation electrode held at a negative potential with respect to the anode to produce an electric field between the anode and the retardation electrode which slows down electrons which have passed through the anode thereby reducing the amount of heat they generate in the tube, wherein the retardation electrode is located on the opposite side of the anode to the cathode, wherein the anode has a thickness of 5 microns or less.

8. A transmission target X-ray tube according to claim 1 wherein the tube further defines a window through which X-rays are emitted and wherein the retardation electrode extends between the anode and the window so that X-rays passing out through the window will pass through the retardation electrode.

9. A transmission target X-ray tube according to claim 8 wherein the anode produces X-rays having a range of energies including a peak energy, and the retardation electrode has an X-ray attenuation which varies with X-ray energy and has a minimum value around a minimum attenuation energy, and wherein the retardation electrode material is selected such that the minimum attenuation energy coincides with the peak energy.

10. A transmission target X-ray tube according to claim 7 wherein the retardation electrode is held at a positive potential with respect to the cathode.

11. A transmission target X-ray tube according to claim 7 wherein the retardation electrode is made of an electrically conducting material.

12. A transmission target X-ray tube according to claim 7 further comprising: a housing enclosing the anode and the cathode, wherein at least a part of the housing forms the retardation electrode.

13. A transmission target X-ray tube according to claim 7 further comprising a housing, wherein the retardation electrode is located between the anode and the housing.

14. A transmission target X-ray tube according to claim 7 wherein the anode is supported on a backing layer of lower atomic number material than the anode.

15. A transmission target X-ray tube according to claim 7 wherein the tube further defines a window through which X-rays are emitted and wherein the retardation electrode extends between the anode and the window so that X-rays passing out through the window will pass through the retardation electrode.

16. A transmission target X-ray tube according to claim 15 wherein the anode produces X-rays having a range of energies including a peak energy, and the retardation electrode has an X-ray attenuation which varies with X-ray energy and has a minimum value around a minimum attenuation energy, and wherein the retardation electrode material is selected such that the minimum attenuation energy coincides with the peak energy.

* * * * *